United States Patent [19]

Cohen

[11] 4,071,966

[45] Feb. 7, 1978

[54] APPARATUS FOR REMOVING SNOW FROM ROADWAY

[76] Inventor: Nathan Cohen, 89 Bradley St., North Haven, Conn. 06473

[21] Appl. No.: 744,441

[22] Filed: Nov. 23, 1976

[51] Int. Cl.[2] ..... E01H 5/10

[52] U.S. Cl. ..... 37/12; 193/31 A

[58] Field of Search ..... 37/12, 43 R, 43 A–43 K, 37/17, 19–27; 193/31 R, 31 A

[56] References Cited

U.S. PATENT DOCUMENTS

| | | | |
|---|---|---|---|
| 2,576,829 | 11/1951 | Fiduccia | 37/12 |
| 2,845,058 | 7/1958 | Wadsworth | 37/12 X |
| 3,106,792 | 10/1963 | Park | 37/12 |
| 3,304,632 | 2/1967 | Kotlar et al. | 37/12 |
| 3,309,798 | 3/1967 | Devlin et al. | 37/12 |
| 3,353,286 | 11/1967 | Marks | 37/12 |
| 3,404,470 | 10/1968 | Raiti | 37/12 |
| 3,619,918 | 11/1971 | Morin | 37/12 |
| 3,803,732 | 4/1974 | Moreno | 37/12 |

FOREIGN PATENT DOCUMENTS

| | | | |
|---|---|---|---|
| 363,253 | 2/1973 | U.S.S.R. | 37/12 |

*Primary Examiner*—E. H. Eickholt

[57] ABSTRACT

Apparatus for removing snow from the surface of a roadway to a disposal site as the roadway vehicle advances and scoops up the snow into a storage chamber. A primary conduit engaging the road surface coupled with a secondary conduit together carry the snow into the storage chamber. The secondary conduit, blower and worm provide means to compensate for variations in vehicle speed and conditions of the snow on the road surface. The snow may be melted at the chamber to economize space and provide easy evacuation of the chamber by a steam generator or flame thrower mounted in the vehicle.

1 Claim, 6 Drawing Figures

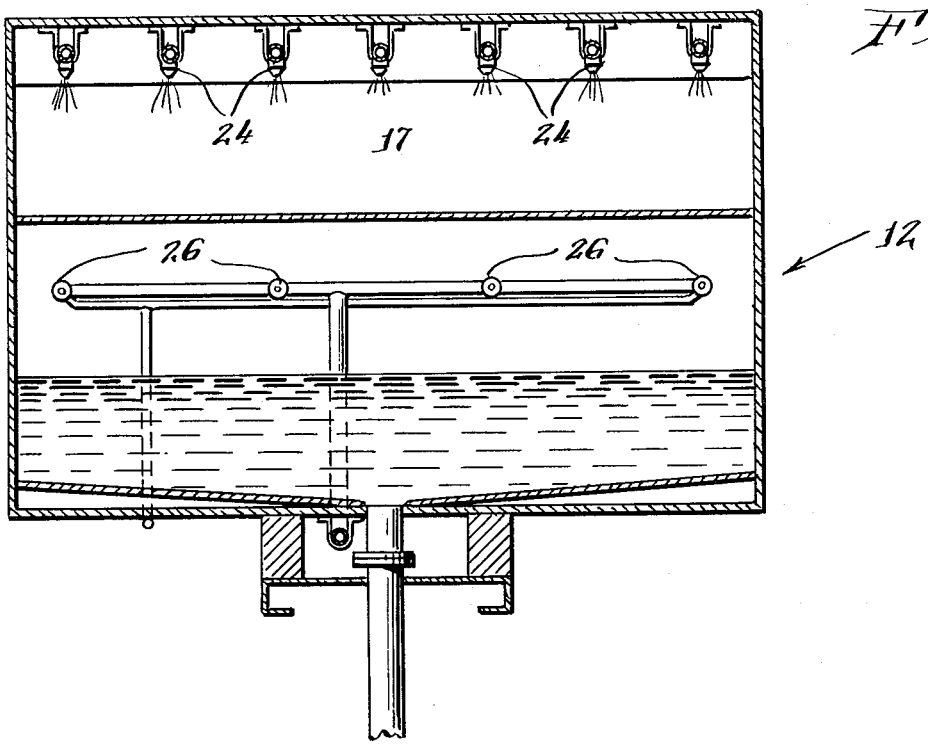
Fig. 4.
Fig. 5.
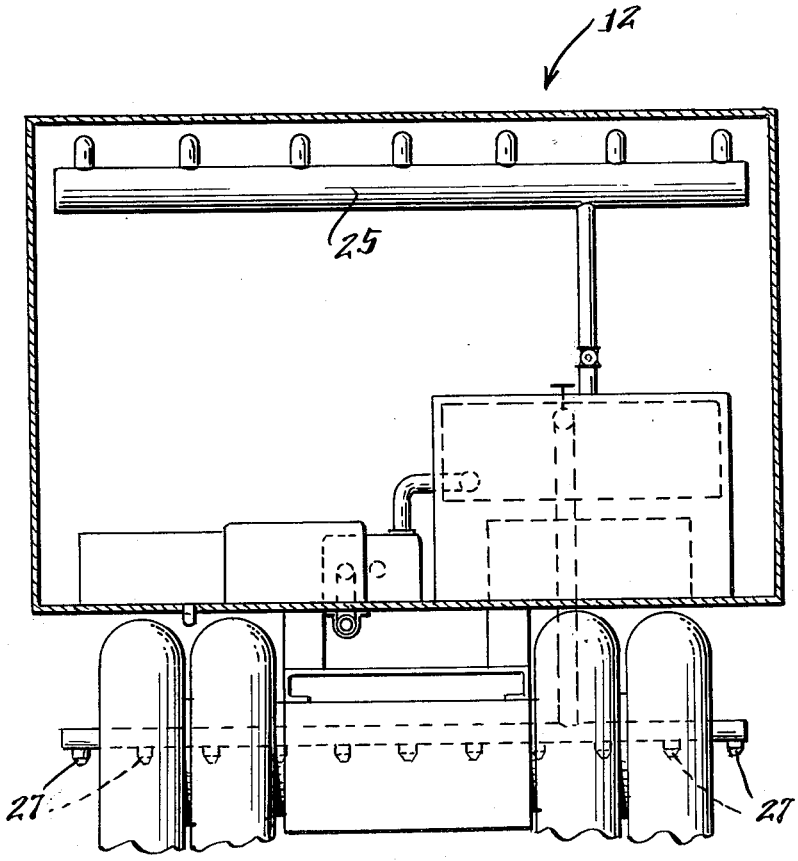

28
23
14
16
20
11
13a

APPARATUS FOR REMOVING SNOW FROM ROADWAY

BACKGROUND OF THE INVENTION

1. Field of the Invention

This involves mobile apparatus moving along the roadway to remove the snow from the surface thereof into storage within the vehicle and to transport the collected snow to a disposal site.

2. Description of Prior Art

Vehicles mounting snow plows proceeded over the roadway pushing the snow from the surface of the road to one side. Some methods use a rotary blade to throw the snow to one side. Another later type carried means to melt the snow by directing streams of hot water or steam onto the surface of the roadway to melt the snow on the road which would then run off. Other means relied on the speed of the road vehicle to scoop the snow into a storage chamber mounted on the vehicle.

SUMMARY OF THE INVENTION

The present invention is an improvement in the method and apparatus for removing the snow from the surface of the roadway and moving it into the storage chamber of the vehicle by the introduction of a two-conduit snow intake system and melting it as it is deposited therein. The improvement provides means to compensate for varying densities of the snow and vehicle speed.

BRIEF DESCRIPTION OF THE DRAWINGS

FIG. 4 is a vertical sectional view taken on line 4—4 of FIG. 3, FIG. 5 is a vertical sectional view taken on line 5—5 of FIG. 3.

DESCRIPTION OF THE PREFERRED EMBODIMENT

Figure 1:
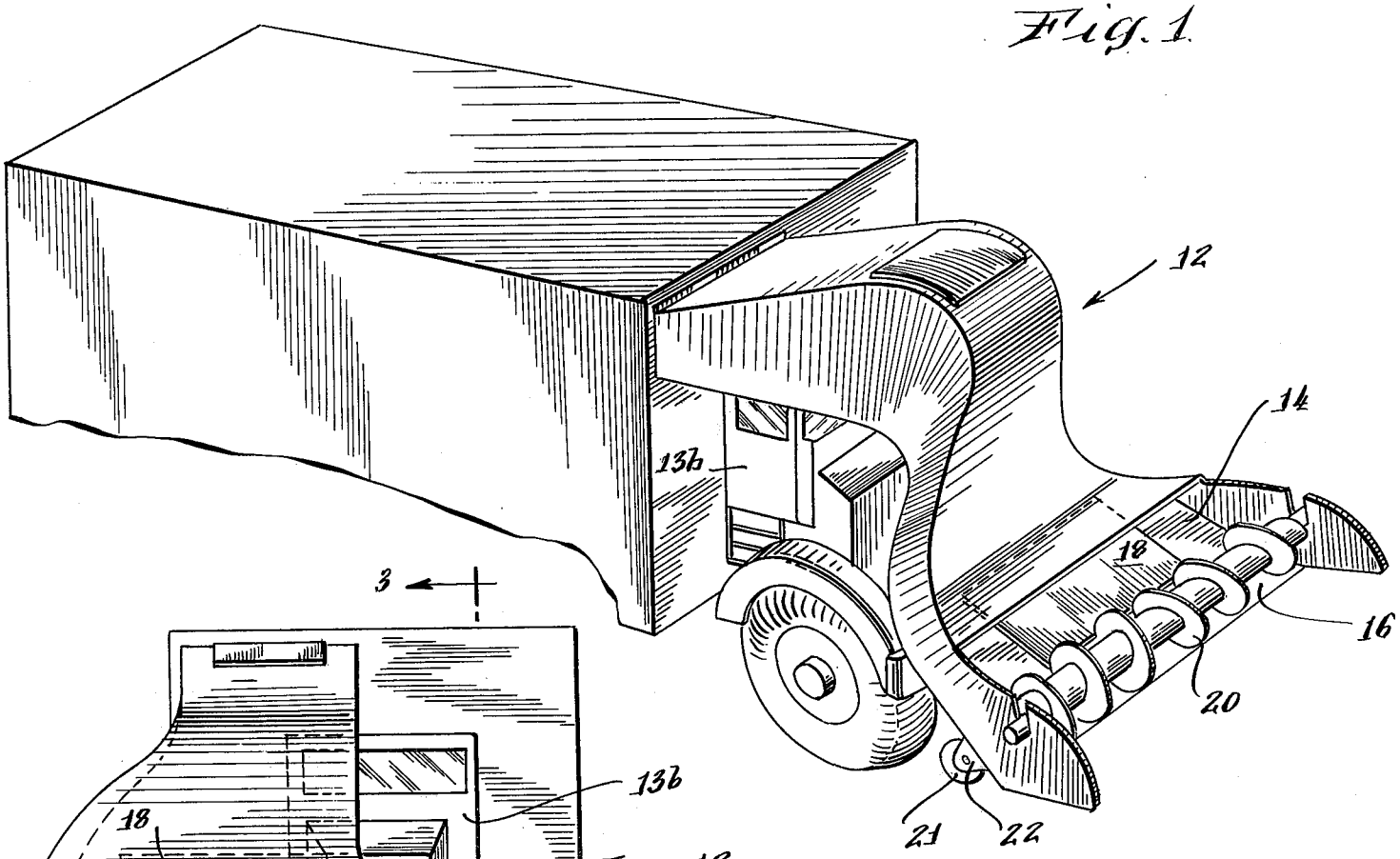
FIG. 1 is a longitudinal perspective view of the snow removal apparatus.
Figure 2:
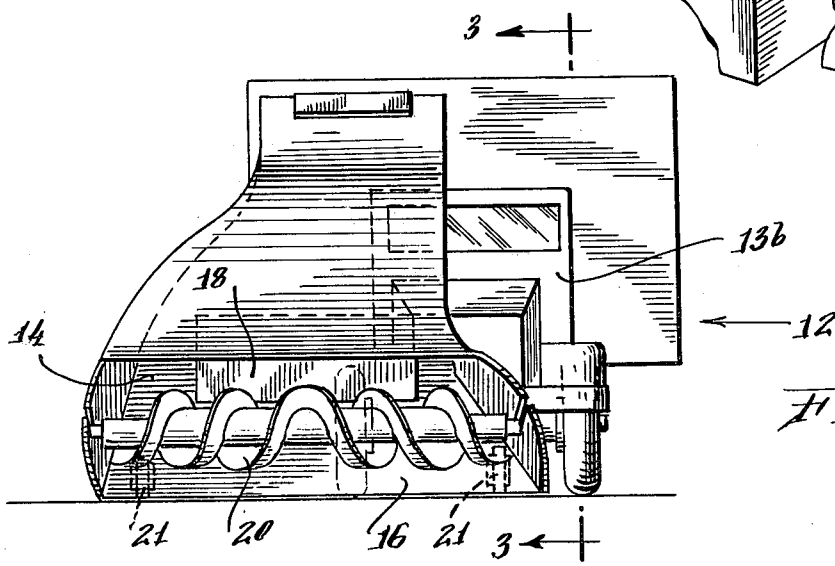
FIG. 2 is an end perspective view of the apparatus shown in FIG. 1.

FIG. 1 and FIG. 2 show two roadway vehicles 11 and 12 for collecting the snow from the surface of the road differing only in the location of the driver's cab 13*a*. In FIG. 1 the cab 13*b* is located rearward of the front axle and on the left side of the vehicle 11. In FIG. 2 the cab 13*b* is forward of the front axle and on the right side of the vehicle 12. FIG. 1 corresponds generally to the driving custom in the U.S. FIG. 2 departs from this custom to permit the driver to be able to accurately guide his vehicle 12 along the right hand edge of the roadway so as to avoid contact with telephone and other poles along the side of the road, also curbs and sidewalks. This latter arrangement also enables the vehicle 12 to proceed easily at a high rate of speed which not only reduces the travel time but aids in raising the snow from the surface of the roadway to the interior of the vehicle 12.

Figure 3:
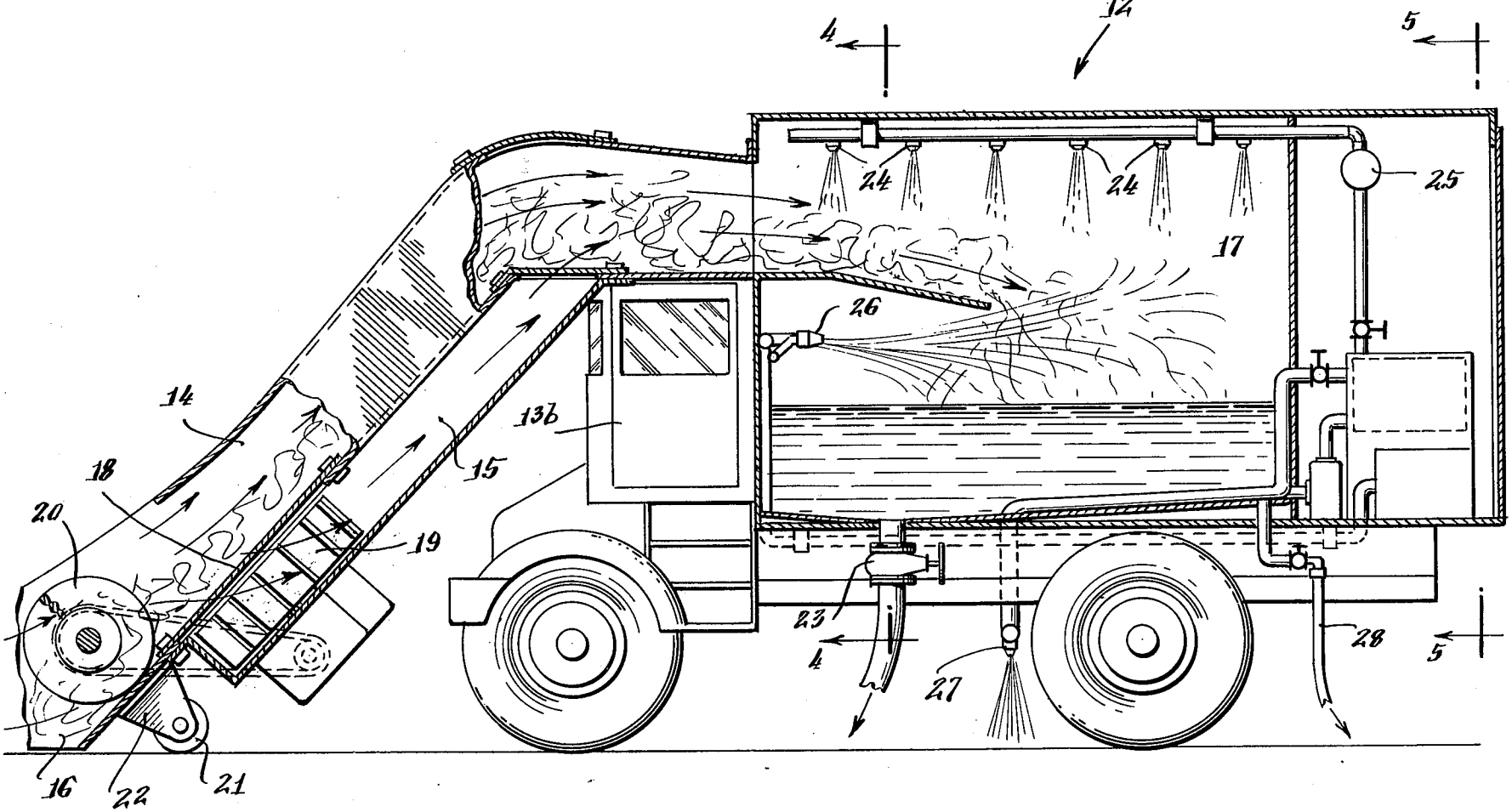
FIG. 3 is a vertical longitudinal schematic view of the apparatus shown in FIG. 1.
Figure 6:
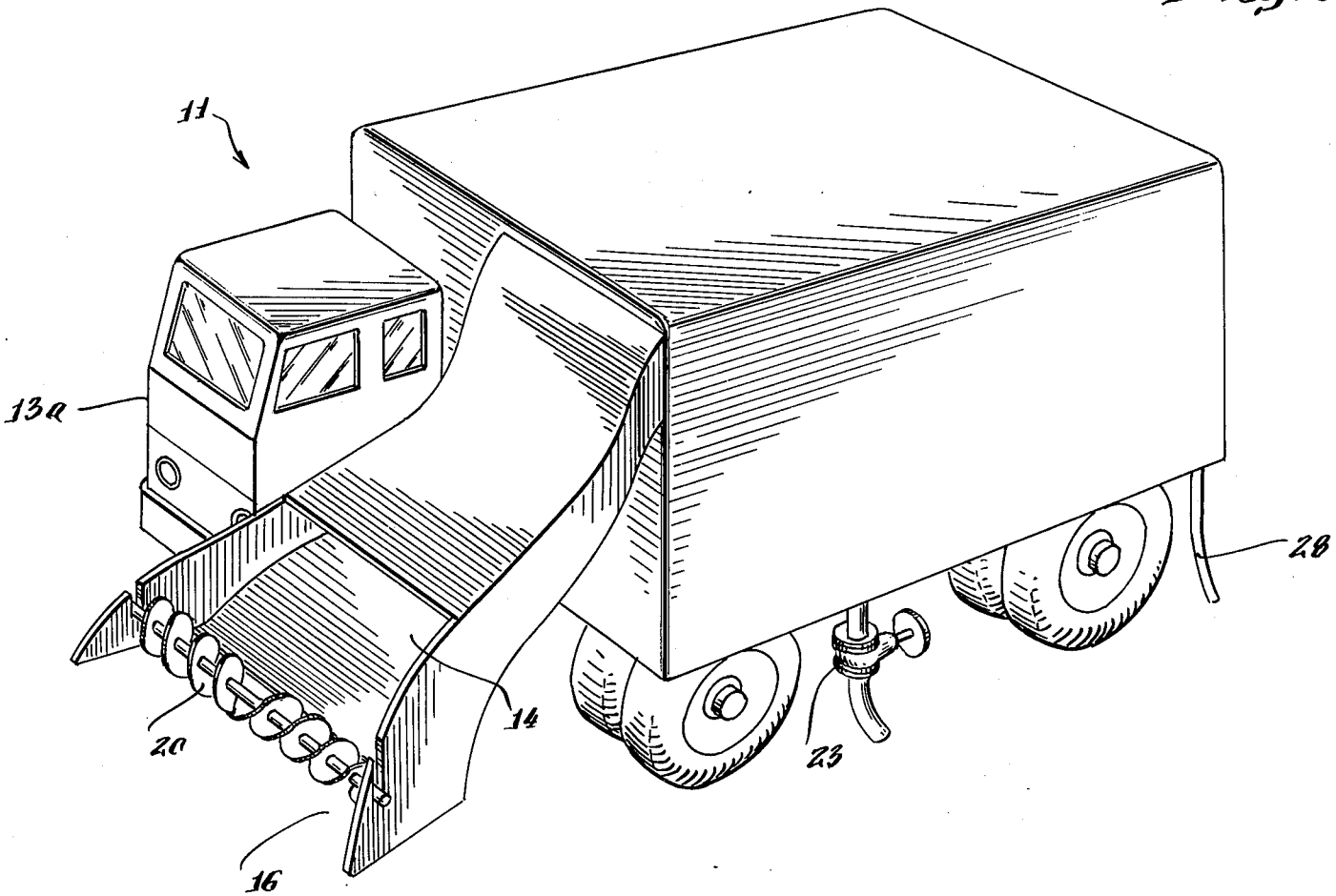
FIG. 6 is a perspective view of another embodiment of the apparatus.

As the vehicle 12 advances the speed of the vehicle scoops the snow into the mouth 16 of the primary conduit 14 and provided the speed of the vehicle 12 and the condition of the snow so permits, the snow is conducted through the primary conduit 13 and discharged into the storate chamber 17 as shown most clearly in FIG. 3.

As shown in FIG. 3 a secondary conduit 15 extends along the side of primary conduit 14 from the intake end of the latter so its discharge end so that snow in the secondary conduit 15 will be discharged into the storage chamber 17 in a similar manner to that from primary conduit 14 when the damper 18 is opened.

If the roadway does not permit of sufficient speed to carry the snow through the primary conduit 14 to be discharged, the damper 18 may be opened to enable the secondary conduit 15 to assist in the passage of the snow. Additional force to move the snow can be provided by operating a blower 19 in the secondary conduit 15 which can be driven by any suitable means, preferably by an electric motor (not shown) powered by an electric generator (not shown) carried in the body of the vehicle 12.

If the snow reposing on the surface of the roadway is crusted, frozen or heavy, the worm 20 may be inserted as shown in FIGS. 1, 2, 4, and 6. This worm 20 may be driven by an electric motor (not shown) in a similar manner to the blower 19 described above.

As shown in FIGS. 1, 2, 3, and 6 the front or lower end of the primary conduit 15 may be carried on small wheels 21 mounted by means of suitable brackets 22 (FIG. 3).

Referring now to FIG. 3 and 4, the storage chamber 17 receives the snow from the conduits 14 and 15 where the moving snow is melted. The snow occupies less storage space when melted and permits easy evacuation by means of a discharge valve 23.

One method of melting the snow is by means of a plurality of steam jets 24 connected to a header 25 as shown in FIGS. 3, 4, and 5 which play upon the snow as it leaves the conduit discharge.

Another method is also shown in FIGS. 3, 4, and 5 which consists of flame jets 26 playing upon the falling snow.

A road surface steam jet 26 is shown in FIG. 3 for melting snow or ice. Another road surface hose connection 28 is provided for the use of heated water for washing down and flushing road surfaces as well as the storage chamber 17.

Another system, not shown, may comprise a battery of tubes assembled in a common header which may contain steam or hot water which can be recycled. This battery would be disposed in the chamber at the level of the discharge openings of the conduits 11 and 12.

The novel arrangement of the double conduit systems extends the scope and use of the snow removal apparatus and thus comprises an improvement over existing apparatus in this field.

With a lightweight snowfall and a straight roadway maximum speed of the vehicle will carry the snow directly into the storage chamber clearing the roadway in minimum time and cost.

In the case of heavy caked, crusted or wet snow the second conduit may be easily and quickly brought into use and if necessary the blower and worm so that the roadway speed of the vehicle may not be obliged to suffer much reduction to move the snow from the roadway to the storage chamber.

In the case of narrow curving roadways and in closed populated districts and where road speed must be reduced, no other special apparatus or vehicle is needed as the second conduit and blower can quickly be brought into use without the need of special vehicles for such detail operations.

Having described my invention, I claim:

1. In a road vehicle apparatus for removing snow and the like from the surface of a roadway as the apparatus advances along the roadway wherein the apparatus includes a storage chamber for holding the snow taken up by the apparatus advancing on the roadway, the improvement in means for removing the snow from the surface of the road and depositing the removed snow in the storage chamber, said improvement comprising (a) an elongated first conduit having an intake first opening at one end for receiving the snow from the roadway and a discharge second opening at its opposite end directed to discharge into the storage chamber;

(b) an elongated second conduit mounted on the first conduit having its intake opening connected into the first conduit adjacent the intake opening of the first conduit and its discharge opening adjacent the discharge opening of the first conduit; and (c) damper means at its intake opening regulating the amount of snow material received from the first conduit.

* * * * *